US009411262B1

(12) United States Patent
Okuda et al.

(10) Patent No.: US 9,411,262 B1
(45) Date of Patent: Aug. 9, 2016

(54) DEVELOPER QUANTITY CONTROL BLADE HAVING BLADE MEMBER COMPOSED OF A THERMOPLASTIC ELASTOMER COMPOSITION AND IMAGE FORMING APPARATUS

(71) Applicant: CANON KABUSHIKI KAISHA, Tokyo (JP)

(72) Inventors: Mitsuru Okuda, Suntou-gun (JP); Yoshinobu Ogawa, Numazu (JP); Hiroshi Morishita, Suntou-gun (JP); Sinya Tokitou, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/001,613

(22) Filed: Jan. 20, 2016

(30) Foreign Application Priority Data

Jan. 30, 2015 (JP) ..... 2015-017072

(51) Int. Cl.
*G03G 15/08* (2006.01)

(52) U.S. Cl.
CPC ..... *G03G 15/0812* (2013.01)

(58) Field of Classification Search
CPC ..... G03G 15/0812
USPC ..... 399/284
See application file for complete search history.

(56) References Cited

U.S. PATENT DOCUMENTS 6,094,555 A * 7/2000 Katoh ..... G03G 15/0812 399/274
2012/0060753 A1* 3/2012 Tanaka ..... G03G 21/0094 118/100
2013/0216286 A1* 8/2013 Hasegawa ..... G03G 21/0094 399/346

FOREIGN PATENT DOCUMENTS

JP 2001-356594 A 12/2001
JP 2004-163742 A 6/2004
JP 2007-293093 A 11/2007

OTHER PUBLICATIONS

Extended European Search Report in European Application No. 16000157.4 (dated May 31, 2016).

* cited by examiner

*Primary Examiner* — Quana M Grainger
(74) *Attorney, Agent, or Firm* — Fitzpatrick, Cella, Harper & Scinto

(57) ABSTRACT

A developer quantity control blade is provided which can sufficiently impart charge to toner and which allows bleeding of a material from a blade member to be suppressed even in application of a voltage. The developer quantity control blade includes a supporting member and a blade member, wherein the blade member is composed of a thermoplastic elastomer composition including a block copolymer having a polyamide structure and a polyether structure, and an ion conductive agent; in the blade member, a quantity of an extraction component to be extracted with methyl isobutyl ketone as a solvent is 0.5% by mass or more and 2.4% by mass or less; and a quantity of a molecule having a molecular weight of 5000 or less in the extraction component is 70% by mass or more.

6 Claims, 3 Drawing Sheets

DEVELOPER QUANTITY CONTROL BLADE HAVING BLADE MEMBER COMPOSED OF A THERMOPLASTIC ELASTOMER COMPOSITION AND IMAGE FORMING APPARATUS

BACKGROUND OF THE INVENTION

1. Field of the Invention

The present invention relates to a developer quantity control blade and an image forming apparatus for use in electrophotographic image formation.

2. Description of the Related Art

In electrophotographic image formation, a developer quantity control blade is used as a unit that controls the thickness of a layer of a developer (hereinafter, also referred to as "toner") so as to make it thin, and here, the developer is born by a developer bearing member and conveyed thereby to an image bearing member. The developer quantity control blade abuts with the developer bearing member to allow the toner to pass through a space between abutment portions, thereby controlling the thickness of the toner layer. A method is also known which includes forming a thin layer of the toner on the developer bearing member and also providing frictional electrification (tribo) that is for developing a latent image to the toner by friction at the abutment portion.

The toner has been recently reduced in particle size in order to achieve an increase in image quality, and therefore the toner may be conveyed to the image bearing member without being sufficiently brought into contact with the developer quantity control blade and the developer bearing member, which causes an insufficient charge of the toner to result in an insufficient image density.

As the method that solves such a problem, a method is considered which includes increasing the abutting pressure of the developer quantity control blade with the developer bearing member to allow the toner to be strongly pushed onto the developer bearing member. In this method, however, the thickness of the toner layer on the developer bearing member may be difficult to sufficiently ensure, and also the toner may be fixed to a nip portion in an abutting region of the developer bearing member with the developer quantity control blade to thereby cause streak-like unevenness in an image.

Japanese Patent Application Laid-Open No. 2007-293093 discloses a method which includes applying a voltage to a developer quantity control blade to thereby generate a difference in potential between a developer bearing member and the developer quantity control blade in order to perform active charge injection to toner. With respect to the method in Japanese Patent Application Laid-Open No. 2007-293093, however, the blade member is configured by a material including a block copolymer having a polyether structure and an ion conductive agent, and it has been found according to studies by the present inventors that the block copolymer and the ion conductive agent may bleed from the blade member to contaminate the developer bearing member to thereby cause horizontal streaks in an image.

In view of bleeding of the material from the blade member, Japanese Patent Application Laid-Open No. 2001-356594 discloses a developer quantity control blade including a polyurethane elastomer produced from a polyol component and a polyisocyanate component as main raw materials, in which the content of a component to be extracted with acetone as a solvent is 10% by mass or less. According to studies by the present inventors, the developer quantity control blade in Japanese Patent Application Laid-Open No. 2001-356594 effectively suppresses bleeding of the material from the blade member; however, it includes no conductive agent, and thus is difficult to apply to the method proposed in Japanese Patent Application Laid-Open No. 2007-293093, which includes applying a voltage to a developer quantity control blade for charge injection to toner.

The present invention is directed to providing a developer quantity control blade that can sufficiently impart charge to toner by application of a voltage to the developer quantity control blade and that allows contamination of a developer bearing member due to bleeding of a material from a blade member to be suppressed.

The present invention is also directed to providing an image forming apparatus that serves for stable formation of a high-quality electrophotographic image.

SUMMARY OF THE INVENTION

According to one aspect of the present invention, there is provided a developer quantity control blade which controls a quantity of a developer to be conveyed from a developer container by a developer bearing member, including: a supporting member; and a blade member, wherein the blade member is composed of a thermoplastic elastomer composition including: a block copolymer having a polyamide structure and a polyether structure, and an ion conductive agent; and wherein, in the blade member, a quantity of an extraction component to be extracted with methyl isobutyl ketone as a solvent is 0.5% by mass or more and 2.4% by mass or less; and a quantity of a molecule having a molecular weight of 5000 or less in the extraction component is 70% by mass or more.

According to another aspect of the present invention, there is provided an image forming apparatus including a developer bearing member and a developer quantity control blade provided in abutment with the developer bearing member, wherein the developer quantity control blade includes a supporting member and a blade member; the blade member is composed of a thermoplastic elastomer composition including: a block copolymer having a polyamide structure and a polyether structure, and an ion conductive agent; and wherein, in the blade member, a quantity of an extraction component to be extracted with methyl isobutyl ketone as a solvent is 0.5% by mass or more and 2.4% by mass or less; and a quantity of a molecule having a molecular weight of 5000 or less in the extraction component is 70% by mass or more.

Further features of the present invention will become apparent from the following description of exemplary embodiments with reference to the attached drawings.

DESCRIPTION OF THE EMBODIMENTS

Figure 1:
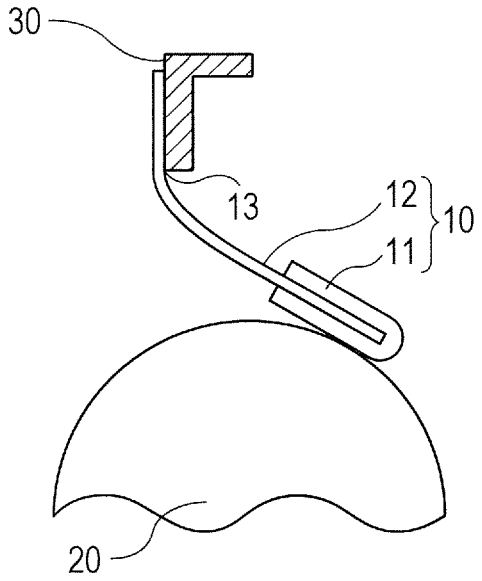
FIG. 1 is a schematic configuration view illustrating one example of the developer quantity control blade of the present invention.

Preferred embodiments of the present invention will now be described in detail in accordance with the accompanying drawings.

A developer quantity control blade according to one aspect of the present invention is a developer quantity control blade that is disposed in abutment with a developer bearing member, that controls a quantity of a developer to be conveyed from a developer container by a developer bearing member, and that satisfies the following requirements (1) to (4):

(1) including a supporting member and a blade member;

(2) the blade member being composed of a thermoplastic elastomer composition including a block copolymer having a polyamide structure and a polyether structure, and an ion conductive agent;

(3) in the blade member, a quantity of an extraction component to be extracted with methyl isobutyl ketone as a solvent, being 0.5% by mass or more and 2.4% by mass or less; and (4) a quantity of a molecule having a molecular weight of 5000 or less in the extraction component being 70% by mass or more.

Hereinafter, the developer quantity control blade according to one aspect of the present invention will be described in detail. For the blade member, a thermoplastic elastomer composition is used which includes a block copolymer having a polyamide structure and a polyether structure, in which an ion conductive agent is dispersed so that the specific volume resistance value is in a moderate resistance range of about $1.0\times10^5$ Ω·cm or more and about $5.0\times10^8$ Ω·cm or less. A thermoplastic elastomer composition including a block copolymer having a polyether structure in a backbone can be used to stabilize an ion of a metal salt or the like in the blade member to thereby result in an effective reduction in electric resistance of the blade member. The block copolymer has a polyamide structure, and therefore has a good frictional electrification ability against toner.

The solvent for use in an extraction treatment of the blade member in the present invention is methyl isobutyl ketone. Methyl isobutyl ketone can be used to thereby effectively extract a component that contaminates the developer bearing member, and a component that interacts with the ion conductive agent to contribute to electro-conductivity, which are present in the blade member.

In the blade member, the quantity of the extraction component to be extracted with methyl isobutyl ketone as a solvent is 0.5% by mass or more and 2.4% by mass or less. The quantity of the molecule having a molecular weight of 5000 or less in the extraction component in the blade member is 70% by mass or more.

If the quantity of the extraction component is more than 2.4% by mass, the surface of the developer bearing member is easily contaminated due to bleeding of the material from the blade member to thereby easily cause horizontal streaks in an image. If the quantity of the extraction component is less than 0.5% by mass, the quantity of a molecule having a molecular weight of 5000 or less is too small; therefore a molecule that contributes to transfer of an ion dissociated in the blade member is decreased and the blade member cannot achieve a required electric resistance value. Herein, examples of the "extraction component" include polyethylene glycol.

In addition, if the quantity of the molecule having a molecular weight of 5000 or less in the extraction component is less than 70% by mass, a molecule that contributes to transfer of an ion dissociated in the blade member is decreased and the blade member cannot achieve a required electric resistance value. Furthermore, the quantity of the molecule having a molecular weight of more than 5000 is increased to thereby cause the component bleeding from the blade member to be attached onto the developer bearing member; thus an external additive of toner is attached or the ion conductive agent included in the bled component changes the potential of the surface of the developer bearing member, which easily cause horizontal streaks in an image.

In the block copolymer having a polyamide structure and a polyether structure, examples of the polyamide structure include the following: a polyamide structure configured from a repeating unit having an amide bond, such as a nylon 6 repeating unit, a nylon 6-6 repeating unit, a nylon 6-10 repeating unit, a nylon 6-12 repeating unit, a nylon 12 repeating unit or a nylon 12-12 repeating unit. Among these polyamide structures, a polyamide structure having a nylon 12 repeating unit can be particularly adopted.

The polyether structure is for example a structure represented by —$((CH_2)_2O)_n$—. Here, n represents an integer of 1 or more.

Specific examples of the block copolymer having the polyamide structure and the polyether structure include "Pelestat N1200" (trade name; produced by Sanyo Chemical Industries, Ltd.) and "Daiamide E40-S4" (trade name; produced by Daicel-Evonik Ltd.).

The structure analysis of each of the polyamide structure and the polyether structure in the block copolymer that forms the blade member can be performed by an infrared absorption spectrum analysis, a nuclear magnetic resonance spectroscopic analysis or the like.

The ion conductive agent that forms the blade member can be detected by subjecting the blade member to an extraction treatment with water, and analyzing the resulting extract by time-of-flight secondary ion mass spectrometry (TOF-SIMS), and an infrared absorption spectrum analysis.

Examples of the ion conductive agent include the following: perchlorates, chlorates, hydrochlorides, bromates, iodates, borohydrofluorides, sulfates, alkyl sulfates, carboxylates and sulfonates of ammoniums, such as tetraethylammonium, tetrabutylammonium, lauryltrimethylammonium, dodecyltrimethylammonium, stearyltrimethylammonium, octadecyltrimethylammonium, hexadecyltrimethylammonium, benzyltrimethylammonium and modified aliphatic dimethylethylammoniums; and perchlorates, chlorates, hydrochlorides, bromates, iodates, borohydrofluorides, trifluoromethanesulfonates, trifluoromethanesulfates, sulfonates and bis(trifluoromethanesulfonic acid)imide salts of alkali metals or alkali earth metals, such as lithium, sodium, calcium and magnesium; and 1,1,2,2,3,3-hexafluoropropane-1,3-disulfonyl difluorides. Among these, in particular, trifluoromethanesulfonates, trifluoromethanesulfates and bis(trifluoromethanesulfonic acid)imide salts of alkali metals can be adopted. Such salts have a structure containing fluorine in an anion, and therefore can have a large effect of imparting electro-conductivity. The ion conductive agent can particularly have a trifluoromethane moiety. The ion conductive agent can be used singly or in combinations of two or more agents.

The content of the ion conductive agent is not particularly limited, and is preferably 0.01 parts by mass or more and 2.00 parts by mass or less, more preferably 0.10 parts by mass or more and 1.00 part by mass or less with respect to 100 parts by mass of the block copolymer having the polyamide structure and the polyether structure. Thus, the volume specific resistance value of the thermoplastic elastomer composition is easily adjusted to be in the range of $1.0\times10^5$ Ω·cm or more and $5.0\times10^8$ Ω·cm or less, and a blade member whose volume specific resistance value is in a moderate resistance range with few variation is easily obtained.

Hereinafter, the developer quantity control blade according to one aspect of the present invention will be more specifically described. The developer quantity control blade includes at least the supporting member and the blade member. The supporting member for use in the developer quantity control blade is not particularly limited as long as the supporting member can support the blade member.

A metal or a resin can be used as a material of the supporting member. Specific examples can include metals such as stainless steel, phosphor bronze and aluminum, and resins such as polyethylene terephthalate, an acrylic resin, polyethylene and polyester. An electro-conductive material can be added to such a resin in order that the resin has a desired electro-conductivity.

The shape of the supporting member can be a plate shape or a curved plate shape obtained by curving thereof. The thickness of the supporting member is not particularly limited, and can be 0.05 mm or more and 0.15 mm or less. When the thickness of the supporting member is 0.05 mm or more, the supporting member can allow the blade member to abut with the developer bearing member at a proper abutment pressure, and the toner on the developer bearing member can be controlled so as to have a proper thickness. On the other hand, when the thickness of the supporting member is 0.15 mm or less, the blade member more easily follows the developer bearing member, and the developer quantity control blade has a spring-like property that imparts a required pressure to toner.

The blade member includes the thermoplastic elastomer composition including the block copolymer having the polyamide structure and the polyether structure, and the ion conductive agent, and is formed on the supporting member. The thickness of the blade member is not particularly limited, and is, for example, 10 μm or more and 1000 μm or less on the abutment support surface of the supporting member. When the thickness of the blade member on the abutment support surface of the supporting member is 10 μm or more, durability to wear due to friction against the developer bearing member can be ensured, and when the thickness is 1000 μm or less, a stable abutment pressure with the developer bearing member can be achieved.

The positional relationship between the blade member and the supporting member is not particularly limited, and the blade member may be arranged on one surface of the supporting member that is a side of abutting with the developer bearing member, or the blade member may be arranged so that the entire surface of the supporting member is covered. The shape of the abutting region of the blade member with the developer bearing member is also not particularly limited, and may be any of flat surface, curved surface, convex and concave shapes.

The blade member can be formed by extrusion molding, coating molding, sheet lamination molding, injection molding or the like. Specific examples include the following formation methods (1) to (3).

(1) In the case of extrusion molding, the supporting member, if necessary, coated with an adhesive is placed in a mold, and the thermoplastic elastomer composition heated and molten is injected into the mold and molded.

(2) In the case of sheet lamination molding, the thermoplastic elastomer molded into a sheet form by extrusion molding or the like is laminated on the supporting member coated with an adhesive.

(3) In the case of injection molding, the thermoplastic elastomer composition is injected into a mold cavity with the supporting member placed therein, and cooled to mold.

In formation of the blade member, an adhesive layer can be formed on the supporting member, if necessary. Examples of the material of the adhesive layer can include hot melt type materials such as polyurethane type, polyester type, ethylene vinyl alcohol type (EVA type) and polyamide type materials.

Figure 2:
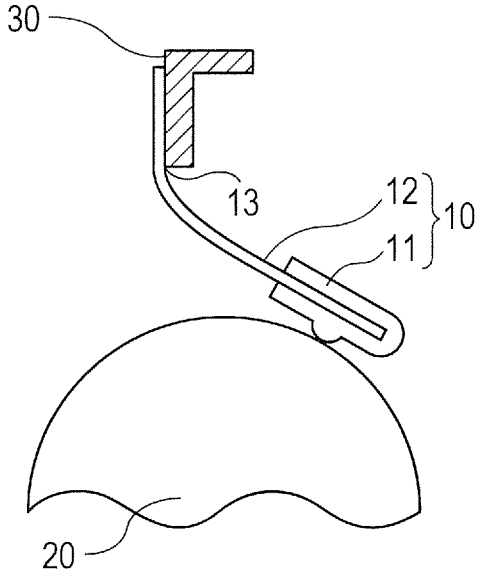
FIG. 2 is a schematic configuration view illustrating another example of the developer quantity control blade of the present invention.
Figure 3:
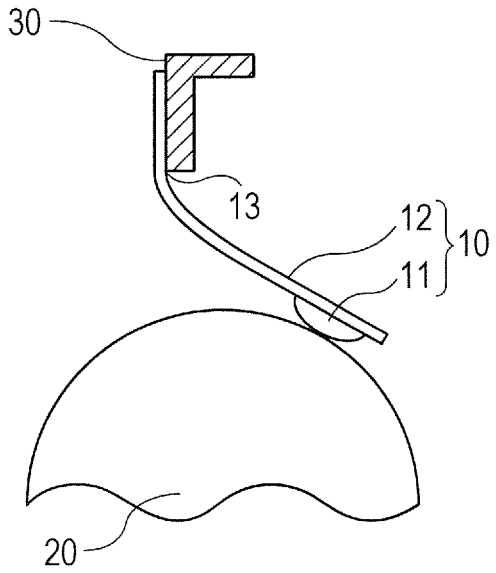
FIG. 3 is a schematic configuration view illustrating still another example of the developer quantity control blade of the present invention.

Specific examples of the developer quantity control blade produced using the supporting member and the blade member can include a blade illustrated in FIG. 1, FIG. 2 and FIG. 3. A developer quantity control blade 10 illustrated in FIG. 1, FIG. 2 and FIG. 3 is configured from a supporting member 12 and a blade member 11. Such a developer quantity control blade 10 is fixed to a developer container 30, and abuts with the surface of a developer bearing member 20 with a fixing point 13 as a supporting point which is in contact with an opening end of the developer container 30. The developer quantity control blade 10 can have such a configuration to thereby allow an intake port, which introduces a particle of toner in a proper quantity, to be formed between the blade 10 and the developer bearing member 20, and allow a developer layer, in which the quantity of charging is uniform and sufficient, to be formed on the developer bearing member.

Figure 4:
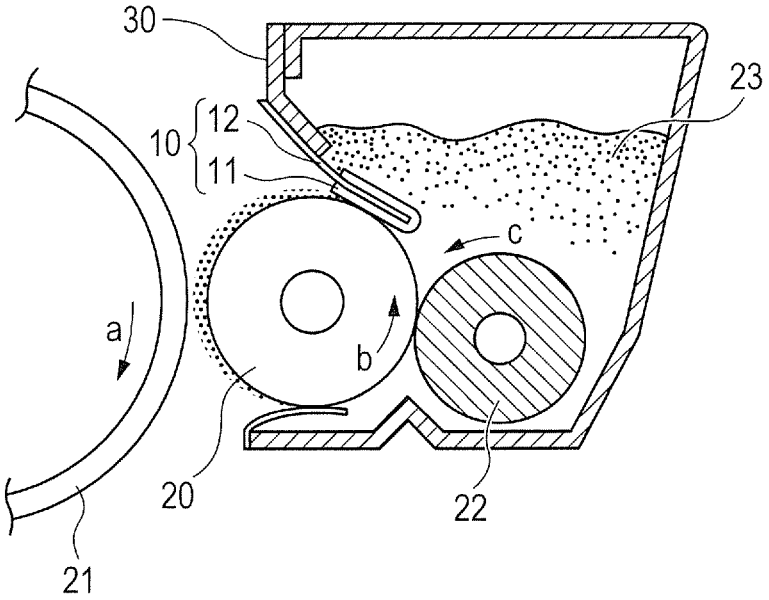
FIG. 4 is a schematic configuration view illustrating one example of the developing apparatus of the present invention.

FIG. 4 is a schematic configuration view illustrating one example of a developing apparatus. In such a developing apparatus, a developer supplying roller 22 is rotated in the arrow c direction, and pressure-contacted onto a developer bearing member 20 rotated in the b direction. A developer 23 pressure-contacted onto the developer bearing member 20 proceeds into a space between a developer quantity control blade 10 and the developer bearing member 20 with the rotation of the developer bearing member 20 in the b direction, and when passes through the space, the developer 23 is rubbed with the surface of the developer bearing member 20 and the blade member of the developer quantity control blade 10 to thereby frictionally electrified and charge-injected. The charged developer 23 is formed into a thin layer on the developer bearing member 20, and conveyed outside a developer container 30 with the rotation of the developer bearing member 20. The developer 23 on the developer bearing member 20 is moved and attached onto an electrostatic latent image on the photosensitive member 21 rotated in the a direction, and the electrostatic latent image is developed and visualized as a toner image. A developer 23 that is not consumed for development of the electrostatic latent image and that remains on the developer bearing member 20 is recovered into the developer container 30 at the lower portion of the developer bearing member 20 with the rotation of the developer bearing member 20, and peeled off from the developer bearing member 20 at the nip portion with the developer supplying roller 22. At the same time, a fresh developer 23 in the developer container 30 is supplied onto the developer bearing member 20 with the rotation of the developer supplying roller 22, and the fresh developer 23 passes through a space between the developer quantity control blade 10 and the developer bearing member 20 and is conveyed to the photosensitive member 21. On the other hand, most of the developer 23 peeled off from the developer bearing member 20 is conveyed into and mixed with a developer 23 in the developer container 30 with the rotation of the developer supplying roller 22, and the electrified charge thereof is dispersed.

Examples of an electrophotographic apparatus to which such a developing apparatus is applied include electrophotographic application apparatuses such as a copier, a laser beam printer, an LED printer and an electrophotographic platemaking system.

An image forming apparatus according to the present invention includes a developer bearing member and a developer quantity control blade provided in abutment with the developer bearing member, in which, the developer quantity control blade is the above developer quantity control blade.

Figure 5:
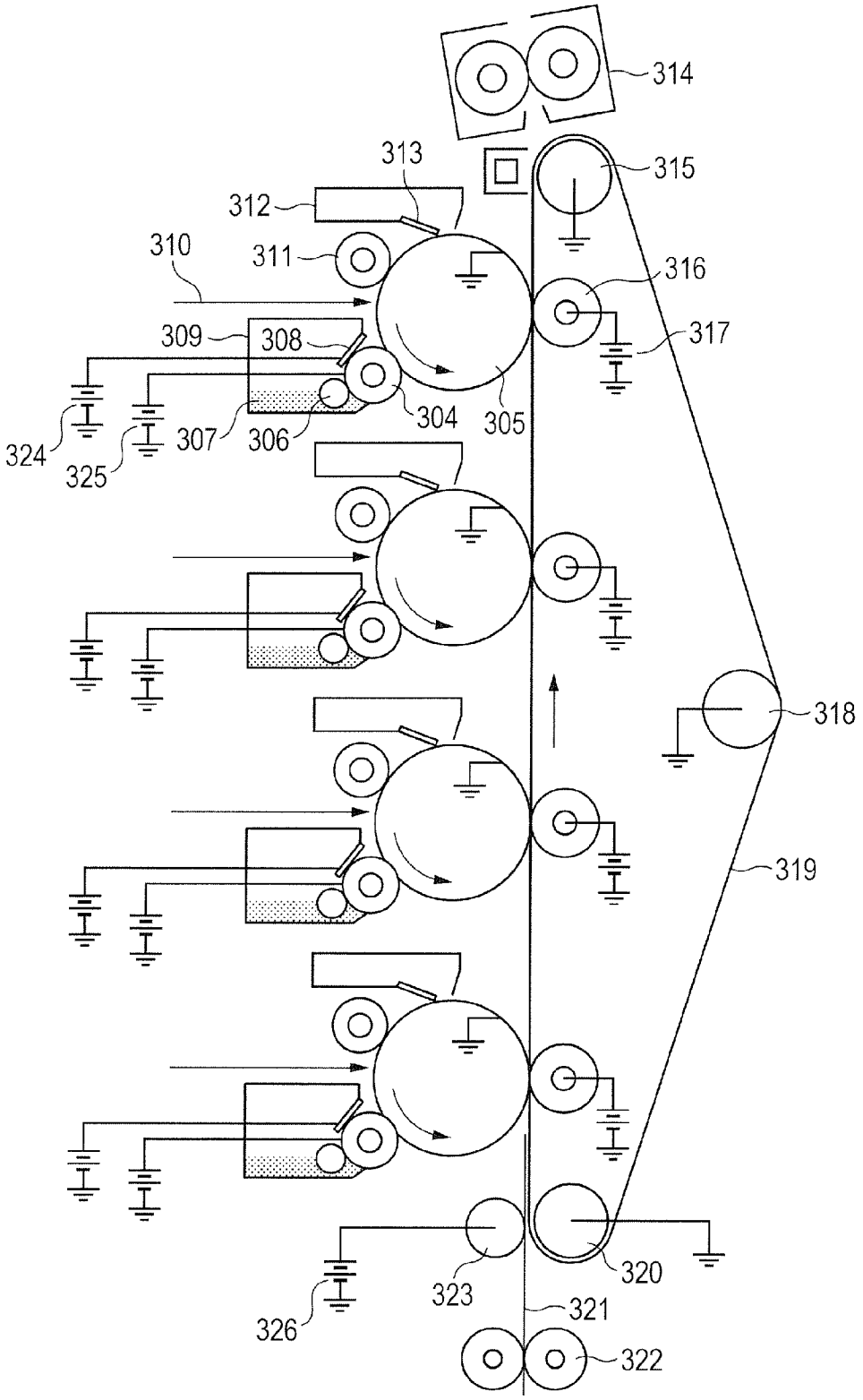
FIG. 5 is a schematic illustration view illustrating one example of the image forming apparatus according to the present invention.

FIG. 5 is a cross-sectional view illustrating one example of a schematic configuration of an electrophotographic image forming apparatus provided with the developer quantity control blade according to the present invention. The image forming apparatus in FIG. 5 includes a roller-shaped developer bearing member (hereinafter, also referred to as "developing roller".) 304, a power source 325 that applies a bias to the developing roller 304, a developer supplying roller 306, a developer (toner) 307, a power source 324 that applies a bias to a developer quantity control blade 308, and a developing apparatus 309 provided with the developer quantity control blade 308 according to the present invention.

The image forming apparatus also includes a photosensitive member 305, a cleaning blade 313, a waste toner accommodating container 312 and a charging roller 311 that is connected to a power source not illustrated.

The photosensitive member 305 is rotated in the arrow direction. The photosensitive member 305 is homogeneously charged by the charging roller 311 that is for performing a charging treatment of the photosensitive member 305. Whereby emitting laser light, an electrostatic latent image is formed on the surface of the photosensitive member 305.

The electrostatic latent image is developed by providing of a developer 307 from the developing apparatus 309 arranged in contact with the photosensitive member 305, and is visualized as a toner image. Such development performed is so-called reversal development where a negatively chargeable toner image is formed on an exposed region.

On the other hand, paper 321 as a recording medium is fed by a paper feed roller 322, thereafter adsorbed onto a transfer conveyance belt 319 by a bias supplied from a bias power source 326 to an adsorption roller 323, and conveyed in the arrow direction by driving of a driving roller 315. The transfer conveyance belt 319 is stretched over the driving roller 315, a driven roller 320 and a tension roller 318. The visualized toner image on the photosensitive member 305 is transferred on the paper 321 adsorbed on the transfer conveyance belt 319 as described above, by a transfer roller 316 as a transfer member. A transfer bias is applied to the transfer roller 316 by a bias power source 317. The paper 321 to which the toner image is transferred is subjected to a fixing treatment by a fixing apparatus 314 and discharged outside the apparatus, and a printing operation is terminated.

On the other hand, a transfer residue toner that is not transferred and that remains on the photosensitive member 305 is scraped off by a cleaning blade 313 as a cleaning member that is for cleaning the surface of the photosensitive member 305, and accommodated in the waste toner container 312. The photosensitive member 305 cleaned is provided to the above image formation operation again.

The developing apparatus 309 includes the developer container that accommodates the developer 307, and the developing roller 304 that is located at an opening extending in the longitudinal direction of the developer container and that is disposed opposite to the photosensitive member 305, and the developing apparatus 309 develops and visualizes the electrostatic latent image on the photosensitive member 305.

The developing process in the developing apparatus 309 is described below. The developing roller 304 is coated with the developer 307 by the developer supplying roller 306 rotatably supported. The developer 307 with which the developing roller 304 is coated is rubbed with the developer quantity control blade 308 by the rotation of the developing roller 304.

The developing roller 304 is here uniformly coated with the developer 307 on the developing roller 304 by the bias applied to the developer quantity control blade 308. The developing roller 304 is brought into contact with the photosensitive member 305 while being rotated, and the electrostatic latent image formed on the photosensitive member 305 is developed by the developer 307 with which the developing roller 304 is coated, thereby forming an image.

The polarity of the bias applied to the developer quantity control blade 308 here is a negative polarity that is the same polarity as the charging polarity of the developer 307, and the voltage thereof is generally a voltage that is higher than the developing bias by several tens V to several hundred V in terms of the absolute value.

The structure of the developer supplying roller 306 can be a foam skeleton sponge structure, or a fur brush structure in which rayon or nylon fibers are mounted on a mandrel, in terms of supplying of the developer 307 to the developing roller 304 and peeling off of the developer 307 not used for development. For example, an elastic roller in which polyurethane foam is provided on a mandrel can be used.

The abutment width of the developer supplying roller 306 with the developing roller 304 can be 1 to 8 mm, and the developer supplying roller 306 can be rotated at a relative rate to the developing roller 304 on the abutment portion.

According to one aspect of the present invention, there is provided a developer quantity control blade that can sufficiently impart charge to toner by application of a voltage and that can allow contamination of other members in abutment therewith, such as a developer bearing member, due to bleeding of a material from a blade member to be suppressed even in the case of application of a voltage. In addition, an image forming apparatus using such a developer quantity control blade can stably form a high-quality electrophotographic image.

EXAMPLES

Hereinafter, the developer quantity control blade and the image forming apparatus of the present invention will be specifically described in detail, but the technical scope of the present invention is not limited thereto.

Example 1

1. Preparation of Thermoplastic Elastomer Composition

One hundred parts by mass of "Pelestat N1200" (polyamide component: 12 nylon, produced by Sanyo Chemical Industries, Ltd.; trade name) was used as a block copolymer having a polyamide structure and a polyether structure, and 1.00 part by mass of lithium trifluoromethanesulfonate (produced by Mitsubishi Materials Electronic Chemicals Co., Ltd.) was used as an ion conductive agent. Such materials were loaded into a kneader, and kneaded at 160° C. for 20 minutes to provide a thermoplastic elastomer composition. Next, the thermoplastic elastomer composition was loaded into a uniaxial extruder and molten at a temperature of 160 to 200° C., and a molten strand-like material was extruded through a nozzle at the tip of the extruder, cooled and cut to provide a pellet.

2. Preparation of Developer Quantity Control Blade

The pellet of the thermoplastic elastomer composition was molten at 200° C., and the thermoplastic elastomer composition was extrusion-molded as a blade member on a SUS plate as a supporting member having a thickness of 0.08 mm to thereby prepare a developer quantity control blade.

3. Extraction Treatment

A blade member sample was cut out to a size of a length of 2 to 5 mm and a width of 2 to 5 mm from the developer quantity control blade, and dried at 80° C. for 12 hours. Thereafter, methyl isobutyl ketone was used as a solvent, and methyl isobutyl ketone and the blade member sample were placed in a container in a mass ratio of 4:1 and left to still stand at a temperature of 23° C. for 72 hours to perform an extraction treatment. After the extraction treatment, a sample liquid was filtrated, the filtrate was recovered, the recovered filtrate was dried using an evaporator under reduced pressure and further dried under reduced pressure at a temperature of 80° C. for 6 hours to provide a dried product of an extraction component, and the mass of the product was measured. The quantity of the dried product of the extraction component relative to the blade member sample was 1.4% by mass.

4. Measurement of Molecular Weight of Extract

The quantity of a molecule having a molecular weight of 5000 or less in the extraction component was analyzed by gel permeation chromatography (GPC). Tetrahydrofuran (THF) was added to the dried product of the extraction component to prepare a 0.5% by mass solution, and the solution was injected to GPC.

Specifically, a GPC gel permeation chromatography apparatus (HLC-8120 manufactured by Tosoh Corporation) was used as a GPC apparatus, and a differential refractive index detector (trade name: RI-8020 manufactured by Tosoh Corporation) was used as a detector. Two polystyrene gel columns (trade name: TSKgel Super HM-M manufactured by Tosoh Corporation) were used in combination as a column. Tetrahydrofuran (THF) was used as an eluent, and GPC measurement was performed at a flow rate of 0.6 ml/min and a temperature of 40° C. The molecular weight distribution was calculated from the relationship between the logarithmic value of the calibration curve created using a monodisperse polystyrene standard sample (trade name: TSKgel Standard Polystyrenes "0005202" to "0005211" produced by Tosoh Corporation) and the retention time. As a result, the quantity of the molecule having a molecular weight of 5000 or less in the extraction component was 97% by mass.

5. Measurement of Volume Specific Resistance Value

The thermoplastic elastomer composition was molded into a sheet having a thickness of 1 to 2 mm, a length of 80 to 150 mm and a width of 80 to 150 mm by a known method, and the volume specific resistance value was measured by Hiresta MCP-HT450, URS Probe (manufactured by Mitsubishi Chemical Analytech Co., Ltd., trade name) at a temperature of 23° C., a relative humidity of 50% and an application voltage of 500 V. The volume specific resistance value of the thermoplastic elastomer composition was $1.00\times10^{6}$ Ω·cm.

6. Evaluation of Horizontal Streaks

The prepared developer quantity control blade was equipped to a toner cartridge for use in a laser printer (trade name: LBP7600C, manufactured by Canon Inc.). Note that, in the laser printer, a bias of −100 to −300 V was applied to the developer quantity control blade. The toner cartridge was stored in a high-temperature and high-humidity environment (temperature: 40° C., relative humidity: 95%) for 30 days. Thereafter, the toner cartridge was installed to the laser printer, and whether or not horizontal streaks were generated in outputting of a solid black image was visually observed and rated according to the following criteria.

Rank A: No horizontal streaks were generated.

Rank B: Horizontal streaks were slightly generated.

Rank C: Horizontal streaks were generated.

7. Evaluation of Image Density

The prepared developer quantity control blade was mounted to a toner cartridge for use in a laser beam LBP7600C (manufactured by Canon Inc.; trade name), and the image density in outputting of a solid black image was evaluated and rated according to the following criteria.

Rank A: A sufficient image density was achieved.

Rank B: A slightly low image density was achieved.

Rank C: A low image density was achieved.

8. Comprehensive Evaluation

The developer quantity control blade was comprehensively evaluated based on the horizontal streak evaluation result and the image density evaluation result, and rated according to the following criteria.

Rank A: Both of the horizontal streak evaluation result and the image density evaluation result were rated as Rank A.

Rank B: Both of the horizontal streak evaluation result and the image density evaluation result were not rated as Rank C, and one or both thereof were rated as Rank B.

Rank C: One or both of the horizontal streak evaluation result and the image density evaluation result were rated as Rank C.

Example 2

A developer quantity control blade was prepared in the same manner as in Example 1 except that the raw material polymer was changed to polymer A, and the blade was evaluated. Polymer A was one in which an extract obtained by an extraction treatment of "Pelestat N1200" with methyl isobutyl ketone was mixed with "Pelestat N1200" not subjected to the extraction treatment, to thereby adjust the quantity of the extract extracted with methyl isobutyl ketone from the blade member to 2.4% by mass. The evaluation results were shown in Table 1.

Example 3

A developer quantity control blade was prepared in the same manner as in Example 1 except that the raw material polymer was changed to polymer B, and the blade was evaluated. Polymer B was obtained as follows: an extract obtained by an extraction treatment of "Pelestat N1200" with methyl isobutyl ketone was mixed with "Pelestat N1200" subjected to the extraction treatment with methyl isobutyl ketone, to thereby adjust the quantity of the extract extracted with methyl isobutyl ketone from the blade member to 0.5% by mass. The evaluation results were shown in Table 1.

Example 4

A developer quantity control blade was prepared in the same manner as in Example 1 except that the raw material polymer was changed to 52 parts by mass of polymer B and 48 parts by mass of polymer D, and the blade was evaluated.

Polymer D was obtained as follows: an extract obtained by an extraction treatment of "Daiamide E40-S4" (polyamide component: 12 nylon produced by Daicel-Evonik Ltd.; trade name) with methyl isobutyl ketone was mixed with "Daiamide E40-S4" subjected to the extraction treatment with methyl isobutyl ketone, to thereby adjust the quantity of the extract extracted with methyl isobutyl ketone from the blade member to 0.5% by mass. The evaluation results were shown in Table 1.

Herein, the quantity of the extraction component obtained by the extraction treatment of "Daiamide E40-S4" with methyl isobutyl ketone was 3.5% by mass.

Examples 5 and 6

Developer quantity control blades were prepared in the same manner as in Example 1 except that the quantities of lithium trifluoromethanesulfonate were changed to 2.00 parts by mass and 0.10 parts by mass, respectively, and the blades were evaluated. The evaluation results were shown in Table 1.

Example 7

A developer quantity control blade was prepared in the same manner as in Example 4 except that the quantity of lithium trifluoromethanesulfonate was changed to 0.10 parts by mass, and the blade was evaluated. The evaluation results were shown in Table 1.

Example 8

A developer quantity control blade was prepared in the same manner as in Example 1 except that lithium bis(trifluoromethanesulfonyl)imide (produced by Mitsubishi Materials Electronic Chemicals Co., Ltd.) was used as the ion conductive agent, and the blade was evaluated. The evaluation results were shown in Table 1.

Example 9

A developer quantity control blade was prepared in the same manner as in Example 1 except that 1,1,2,2,3,3-hexafluoropropane-1,3-disulfonyl difluoride (produced by Mitsubishi Materials Electronic Chemicals Co., Ltd.) was used as the ion conductive agent, and the blade was evaluated. The evaluation results were shown in Table 1.

Example 10

A developer quantity control blade was prepared in the same manner as in Example 1 except that the quantity of lithium trifluoromethanesulfonate was changed to 2.20 parts by mass, and the blade was evaluated. The evaluation results were shown in Table 1.

Example 11

A developer quantity control blade was prepared in the same manner as in Example 4 except that the quantity of lithium trifluoromethanesulfonate was changed to 0.01 parts by mass, and the blade was evaluated. The evaluation results were shown in Table 1.

Comparative Example 1

A developer quantity control blade was prepared in the same manner as in Example 1 except that the raw material polymer was changed to "Daiamide E40-S4", and the blade was evaluated. The evaluation results were shown in Table 2.

Comparative Example 2

A developer quantity control blade was prepared in the same manner as in Example 1 except that the raw material polymer was changed to polymer F, and the blade was evaluated.

Polymer F was obtained as follows: 51 parts by mass of an extract obtained by an extraction treatment of "Pelestat N1200" with methyl isobutyl ketone was mixed with 49 parts by mass of an extract obtained by an extraction treatment of "Daiamide E40-S4" with methyl isobutyl ketone to provide a mixture (hereinafter, also referred to as "mixed extract".), and a predetermined quantity of the mixture was mixed with "Pelestat N1200" subjected to the extraction treatment with methyl isobutyl ketone. The evaluation results were shown in Table 2.

Comparative Example 3

A developer quantity control blade was prepared in the same manner as in Example 1 except that the raw material polymer was changed to polymer E and the quantity of lithium trifluoromethanesulfonate was changed to 2.40 parts by mass, and the blade was evaluated.

Polymer E was obtained as follows: a molecule having a molecular weight of 5000 or more was fractionated from an extract obtained by an extraction treatment of Pelestat N1200 with methyl isobutyl ketone, and mixed with "Pelestat N1200" subjected to the extraction treatment with methyl isobutyl ketone, to thereby adjust the quantity of the extract extracted with methyl isobutyl ketone from the blade member to 1.4% by mass and also adjust the proportion of a molecule having a molecular weight of 5000 or less in the extraction component to 65% by mass. The evaluation results were shown in Table 2.

Comparative Example 4

A developer quantity control blade was prepared in the same manner as in Example 1 except that no ion conductive agent was added, and the blade was evaluated. The evaluation results were shown in Table 2.

TABLE 1

| | | Example 1 | Example 2 | Example 3 | Example 4 | Example 5 | Example 6 |
|---|---|---|---|---|---|---|---|
| "Pelestat N1200" | part(s) by mass | 100 | | | | 100 | 100 |
| Polymer A | part(s) by mass | | 100 | | | | |
| Polymer B | part(s) by mass | | | 100 | 52 | | |
| "Daiamide E40-S4" | part(s) by mass | | | | | | |
| Polymer D | part(s) by mass | | | | 48 | | |
| Polymer E | part(s) by mass | | | | | | |
| Polymer F | part(s) by mass | | | | | | |

TABLE 1-continued

| | | | | | | | |
|---|---|---|---|---|---|---|---|
| Lithium trifluoromethanesulfonate | part(s) by mass | 1 | 1 | 1 | 1 | 2 | 0.1 |
| Lithium bis(trifluoromethanesulfonyl)imide | part(s) by mass | | | | | | |
| 1,1,2,2,3,3-Hexafluoropropane-1,3-disulfonyl difluoride | part(s) by mass | | | | | | |
| Quantity of extract | % by mass | 1.4 | 2.4 | 0.5 | 0.5 | 1.4 | 1.4 |
| Proportion of molecule having molecular weight of 5000 or less to extraction component | % by mass | 97 | 97 | 97 | 70 | 97 | 97 |
| Volume specific resistance value | Ω · cm | 1.00E+06 | 6.00E+05 | 8.00E+06 | 1.00E+08 | 5.00E+05 | 4.00E+08 |
| Horizontal streak evaluation result | Rank | A | A | A | A | A | A |
| Image density evaluation result | Rank | A | A | A | A | A | A |
| Comprehensive evaluation result | Rank | A | A | A | A | A | A |

| | | Example 7 | Example 8 | Example 9 | Example 10 | Example 11 |
|---|---|---|---|---|---|---|
| "Pelestat N1200" | part(s) by mass | | 100 | 100 | 100 | |
| Polymer A | part(s) by mass | | | | | |
| Polymer B | part(s) by mass | 52 | | | | 52 |
| "Daiamide E40-S4" | part(s) by mass | | | | | |
| Polymer D | part(s) by mass | 48 | | | | 48 |
| Polymer E | part(s) by mass | | | | | |
| Polymer F | part(s) by mass | | | | | |
| Lithium trifluoromethanesulfonate | part(s) by mass | 0.1 | | | 2.2 | 0.01 |
| Lithium bis(trifluoromethanesulfonyl)imide | part(s) by mass | | 1 | | | |
| 1,1,2,2,3,3-Hexafluoropropane-1,3-disulfonyl difluoride | part(s) by mass | | | 1 | | |
| Quantity of extract | % by mass | 0.5 | 1.4 | 1.4 | 1.4 | 0.5 |
| Proportion of molecule having molecular weight of 5000 or less to extraction component | % by mass | 70 | 97 | 97 | 97 | 70 |
| Volume specific resistance value | Ω · cm | 5.00E+08 | 1.00E+06 | 7.00E+08 | 4.50E+05 | 9.00E+08 |
| Horizontal streak evaluation result | Rank | A | A | A | B | A |
| Image density evaluation result | Rank | A | A | B | A | B |
| Comprehensive evaluation result | Rank | A | A | B | B | B |

TABLE 2

| | | Comparative Example 1 | Comparative Example 2 | Comparative Example 3 | Comparative Example 4 |
|---|---|---|---|---|---|
| "Pelestat N1200" | part(s) by mass | | | | 100 |
| Polymer A | part(s) by mass | | | | |
| Polymer B | part(s) by mass | | | | |
| "Daiamide E40-S4" | part(s) by mass | 100 | | | |
| Polymer D | part(s) by mass | | | | |
| Polymer E | part(s) by mass | | | 100 | |
| Polymer F | part(s) by mass | | 100 | | |
| Lithium trifluoromethanesulfonate | part(s) by mass | 1 | 1 | 2.4 | 0 |
| Lithium bis(trifluoromethanesulfonyl)imide | part(s) by mass | | | | |
| 1,1,2,2,3,3-Hexafluoropropane-1,3-disulfonyl difluoride | part(s) by mass | | | | |
| Quantity of extract | % by mass | 3.5 | 0.3 | 1.4 | 1.4 |
| Proportion of molecule having molecular weight of 5000 or less to extraction component | % by mass | 41 | 68 | 65 | 97 |
| Volume specific resistance value | Ω · cm | 2.00E+08 | 2.50E+09 | 7.00E+08 | 1.00E+09 |
| Horizontal streak evaluation result | Rank | C | A | C | A |
| Image density evaluation result | Rank | A | C | C | C |
| Comprehensive evaluation result | Rank | C | C | C | C |

As shown in the results shown in Table 1 and Table 2, when the quantity of the extraction component, in the thermoplastic elastomer composition of the blade member, to be extracted with methyl isobutyl ketone was more than 2.4% by mass as in Comparative Example 1, horizontal streaks due to bleeding from the blade member were generated in an image.

When the proportion of the molecule having a molecular weight of 5000 or less in the extraction component in the thermoplastic elastomer was less than 70% by mass as in each of Comparative Examples 2 and 3, the volume specific resistance value of the thermoplastic elastomer was too high to sufficiently perform charge injection to toner, and the image density was low.

In Comparative Example 4, because no ion conductive agent was added, the volume specific resistance value of the thermoplastic elastomer was too high to sufficiently perform charge injection to toner, and the image density was low.

On the contrary, in each of Examples, generation of horizontal streaks in an electrophotographic image was rarely observed, and an electrophotographic image having a sufficient density was obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-017072, filed Jan. 30, 2015, which is hereby incorporated by reference herein in its entirety.

What is claimed is:

1. A developer quantity control blade, which controls a quantity of a developer to be conveyed from a developer container by a developer bearing member, comprising:

a supporting member; and a blade member, wherein the blade member is composed of a thermoplastic elastomer composition comprising:

a block copolymer having a polyamide structure and a polyether structure, and an ion conductive agent, wherein, in the blade member, a quantity of an extraction component to be extracted with methyl isobutyl ketone as a solvent is from 0.5% by mass to 2.4% by mass, and wherein a quantity of a molecule having a molecular weight of 5000 or less in the extraction component is 70% by mass or more.

2. The developer quantity control blade according to claim 1, wherein the ion conductive agent has a trifluoromethane moiety.

3. The developer quantity control blade according to claim 1, wherein a content of the ion conductive agent is from 0.01 parts by mass to 2.00 parts by mass with respect to 100 parts by mass of the block copolymer.

4. The developer quantity control blade according to claim 1, wherein a volume specific resistance value of the thermoplastic elastomer composition is form $1.0\times10^5$ Ω·cm to $5.0\times10^8$ Ω·cm.

5. An image forming apparatus comprising a developer bearing member and a developer quantity control blade provided in abutment with the developer bearing member, wherein the developer quantity control blade comprises a supporting member and a blade member, wherein the blade member is composed of a thermoplastic elastomer composition comprising:

a block copolymer having a polyamide structure and a polyether structure, and an ion conductive agent, wherein, in the blade member, a quantity of an extraction component to be extracted with methyl isobutyl ketone as a solvent is from 0.5% by mass to 2.4% by mass, and wherein a quantity of a molecule having a molecular weight of 5000 or less in the extraction component is 70% by mass or more.

6. The image forming apparatus according to claim 5, further comprising a power source that applies a bias to the developer quantity control blade.

* * * * *